US009271898B2

(12) United States Patent
Flynn

(10) Patent No.: US 9,271,898 B2
(45) Date of Patent: Mar. 1, 2016

(54) PILL ORGANIZER AND DISPENSER

(71) Applicant: Michael Patrick Flynn, Durango, CO (US)

(72) Inventor: Michael Patrick Flynn, Durango, CO (US)

( * ) Notice: Subject to any disclaimer, the term of this patent is extended or adjusted under 35 U.S.C. 154(b) by 120 days.

(21) Appl. No.: 13/864,989

(22) Filed: Apr. 17, 2013

(65) Prior Publication Data

US 2014/0311942 A1 Oct. 23, 2014

(51) Int. Cl.
*A61J 1/03* (2006.01)
*A61J 7/00* (2006.01)

(52) U.S. Cl.
CPC ..... *A61J 7/0069* (2013.01); *A61J 1/035* (2013.01)

(58) Field of Classification Search
CPC ..... A61J 1/03; A61J 1/035; A61J 7/0069; B65D 83/04; B65D 75/327; B65D 75/325; B65D 75/36; B65D 75/367; B65D 83/0445; B65D 83/0481
USPC ..... 206/538, 528, 539, 468, 534, 532
See application file for complete search history.

(56) References Cited

U.S. PATENT DOCUMENTS 4,038,937 A * 8/1977 Moe ..... 116/308
4,062,445 A * 12/1977 Moe ..... 206/1.5
4,593,819 A * 6/1986 Will ..... 206/538
4,872,559 A * 10/1989 Schoon ..... 206/538
5,240,113 A * 8/1993 Gibilisco ..... 206/534
5,379,899 A * 1/1995 Thurell ..... 206/538
5,381,904 A * 1/1995 Thurell ..... 206/538
5,788,079 A * 8/1998 Bouthiette ..... 206/534
6,338,408 B1 * 1/2002 Anderson ..... 206/538
6,382,420 B1 * 5/2002 Bouthiette ..... 206/534
7,802,683 B2 * 9/2010 Bourque ..... 206/539
8,607,983 B2 * 12/2013 Niven et al. ..... 206/538
8,757,381 B2 * 6/2014 Bouthiette ..... 206/534
2006/0086639 A1 * 4/2006 Priebe et al. ..... 206/528
2007/0205132 A1 * 9/2007 Bouthiette ..... 206/538
2008/0023366 A1 * 1/2008 Bouthiette ..... 206/532
2008/0289989 A1 * 11/2008 Kalvelage et al. ..... 206/531
2010/0147733 A1 * 6/2010 Pabari et al. ..... 206/532
2011/0089076 A1 * 4/2011 Niven ..... 206/538

* cited by examiner

*Primary Examiner* — Steven A. Reynolds
(74) *Attorney, Agent, or Firm* — Ali Shalchi, Esq.

(57) ABSTRACT

A device is provided for storing, organizing, and dispensing prescription pills that includes a clamshell container configured to house a pill tray, pill tray lid, and sliding card. The pill tray contains an array of pill chambers that are covered by the pill tray lid, or alternatively, by an adhesive foil seal. The clamshell container includes a top portion and a bottom portion, the top portion having an array of pill holes that correspond with the chambers of the pill tray. The top of the sliding card has markings corresponding to the pill chambers beneath it and slides over the pill tray and beneath the top portion of the claim shell. Pills are placed within the pill holes on top of the sliding card. When the sliding card is removed, the pills fall through the pill holes and into the pill chambers of the pill tray.

9 Claims, 8 Drawing Sheets

PILL ORGANIZER AND DISPENSER

RELATED U.S. APPLICATION DATA

This application claims priority to Provisional application No. 61/625,310, filed Apr. 17, 2012.

FIELD OF THE INVENTION

The present invention relates to containers for storing and organizing pills.

BACKGROUND OF THE INVENTION

With today's aging population and increased usage of prescription drugs, there is a need for a simple means of storing and organizing prescription pills in a secure and convenient manner. With the prevalence of prescription drug usage, it is common many individuals to take many pills on a daily basis. For example, if an individual is taking ten different pills a day, then they face a burden in opening and closing ten bottles every day. Some individuals often forget to take some of their daily pills, or forget whether they have taken the day's pills all together. Also, it is desirable to store prescription pills in a manner that is secure from unwanted access by children, minors, or other individuals (e.g. hotel maids or house guests). This is particularly important because ingestion of prescription medicines by children or minors can result in illness or death. Storage of prescription pills in their native bottles does not deter unwanted access and usage because pills can be removed without detection. Given the large and varying quantity of pills within a prescription bottle, an owner cannot practically keep track of how many pills remain in a particular bottle, and will not notice if one or even several pills are removed. Thus there is a need for a device that stores and organizes prescription pills in a secure manner that deters tampering.

SUMMARY OF THE INVENTION

A device is provided for storing, organizing, and dispensing prescription pills. The device comprises a clamshell container that houses a pill tray, pill tray lid, and a sliding card. The pill tray includes an array of pill chambers that mate with the pill tray lid via a locking mechanism. The clamshell container comprises a top portion and a bottom portion that are hingedly connected, the top portion having an array of pill holes that correspond with the chambers of the pill tray. In an alternative embodiment, the top and bottom portions of the claim shell slide together. The top of the sliding card has markings corresponding to the pill chambers beneath it and slides over the pill tray and beneath the top portion of the claim shell. Pills are placed within the pill holes on top of the sliding card. When the sliding card is removed, the pills fall through the pill holes and into the pill chambers of the pill tray. The pill tray lid can then be placed over the pill tray to secure the contents of the chambers and prevent the pills from falling and preventing unwanted contaminants or fluids from entering the pill chambers. The pill tray lid also acts to deter tampering and unwanted access or removal of pills. In an alternate embodiment, the sliding card is replaced with a sheet of adhesive foil or paper that is applied to the pill tray and seals the pill chambers. The adhesive foil or paper contains marks corresponding to the pill chambers (e.g. schedules, numeric counts, days, times, etc.).

DETAILED DESCRIPTION

Figure 1:
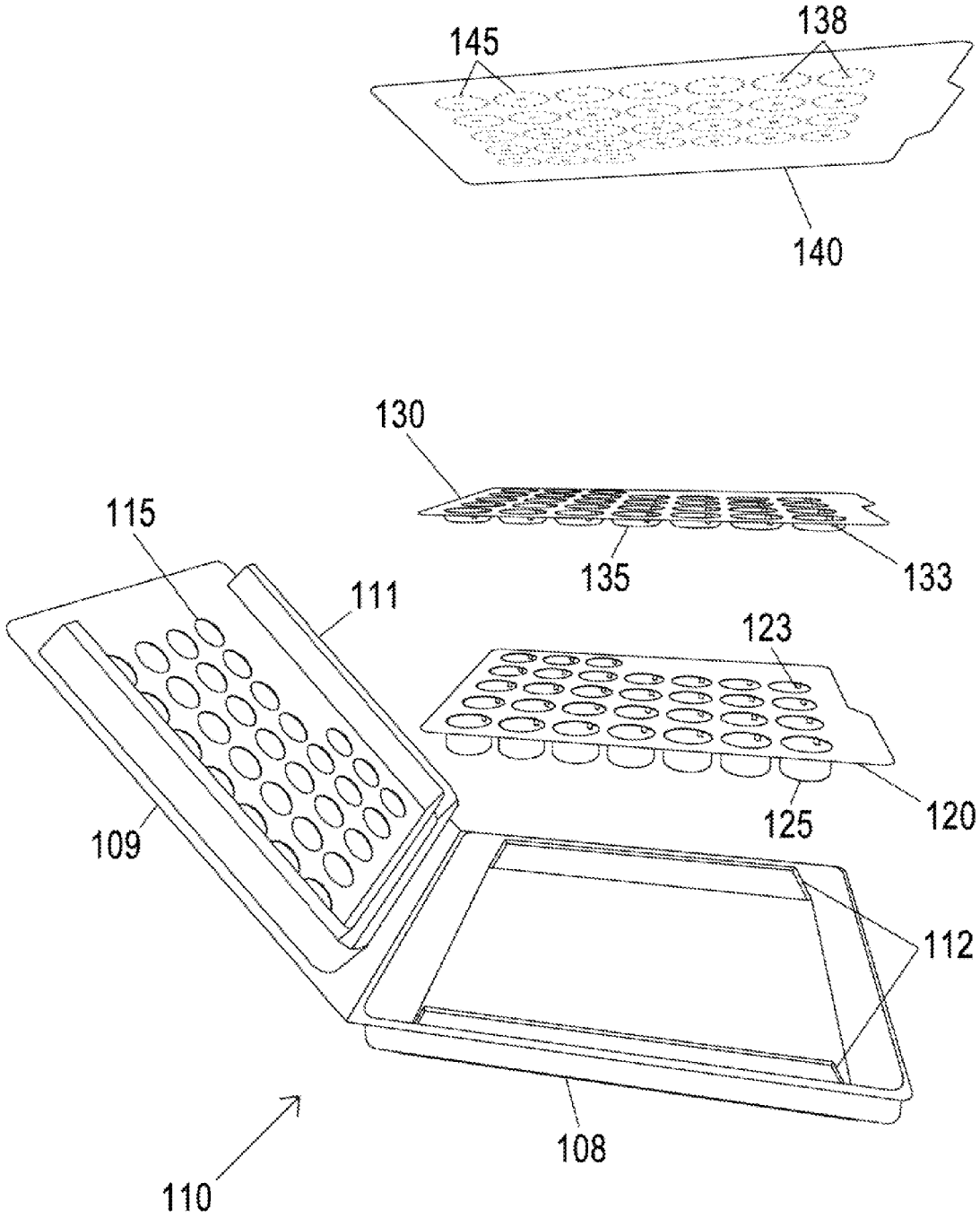
FIG. 1 illustrates an exploded view of the present invention that includes a clamshell container, pill tray, pill tray lid, and sliding card.

Referring to FIG. 1, the device of the present invention includes four discrete parts: clamshell container 110, pill tray 120, tray lid 130, and sliding card 140. As shown in FIG. 1, the clamshell 110 is open. Clamshell container 110 further comprises a bottom portion 108, a top portion 109, a female lining 111, linear protrusions 112, and pill holes 115. The bottom portion 108 and top portion 109 of the clamshell are connected by a hinged joint. The top portion 108 of the clamshell has an array of pill holes 115 that correspond with pill chambers 125 of the pill tray 120. The female lining 111 is configured to cover and receive the protrusions 112 when the clamshell 110 is closed. Pill tray 120 further comprises locking teeth or notches 123 that reside on an inner surface of pill chambers 125. Pill tray lid 130 further comprises locking teeth or notches 133 that reside on an outer surface of pill chamber lids135. As the pill tray lid 130 is pressed onto the top surface of the pill tray 120, the chamber lids 135 are forced into the opening of pill chambers 125 and the protruding notches 135 interface with the complimentary grooves 123 in the pill chambers 125. The protruding notches 135 engage with the grooves 123 to form a reversible bond and keeps the pill tray lid secured to the pill tray, keeping the contents of the pill chambers secure. Alternatively, reversible bonding of the pill tray and pill tray lid can be achieved without the need for grooves 123. In such an embodiment, the interface of the protruding notch 123 with the wall of the pill chamber 125 will be sufficient to create a frictional bond to keep the tray lid attached to the pill tray until the user decides to disengage the two in order to access the pill chambers.

The notches provide for a frictional, reversible locking mechanism between the pill tray and pill tray lid. This allows the pill chambers to be securely sealed to prevent contamination or loss of pills from the pill chambers. The top of the sliding card 140 has markings 145 that outline and corresponding to the pill chambers beneath it. Additional markings 138 designate the pill chambers (e.g. sequential numbering from 1 through 31). The clamshell container is preferably made of a durable polymeric material while the pill tray, pill tray lid and sliding card are more suitably made of disposable materials.

The sliding card 140 slides over the pill tray, and the linear protrusions 112, and beneath the top portion of the claim shell. Pills are placed within the pill holes on top of the sliding card 140 to allocate them to the corresponding pill chambers. Once allocation is complete, the sliding card 140 is removed, and the pills fall through the pill holes 115 and into the pill chambers 125 of the pill tray 120. This process can be repeated to add additional pills to the pill chambers. In the alternative embodiment of FIG. 7, the sliding card is replaced by a user-applied adhesive foil seal as described below. The pill chambers 125 are preferably made of thin, deformable material such as plastic (or other polymeric material) so that the pills can be more easily removed from the pill chambers by pushing the pill chamber upward to push the pills upward and out of the pill chamber. Alternatively, the pill tray and pill chambers can be made of a durable, rigid material (e.g. durable polymeric material). While an exemplary number of pill chambers are shown, other quantities and array configuration can be utilized in accordance with the present invention.

Figure 2:
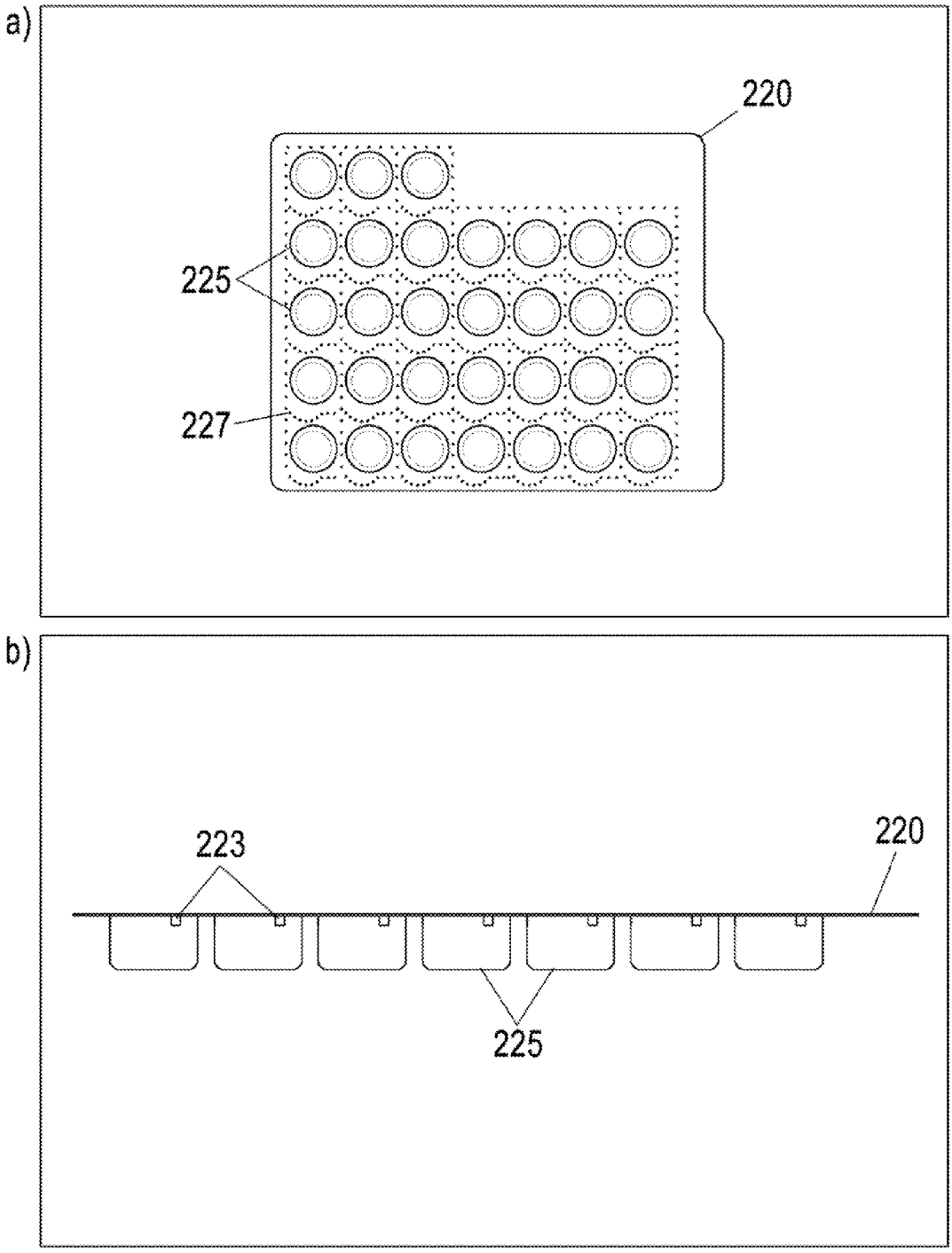
FIGS. 2*a-b* illustrates top view and side views of the pill tray.
Figure 3:
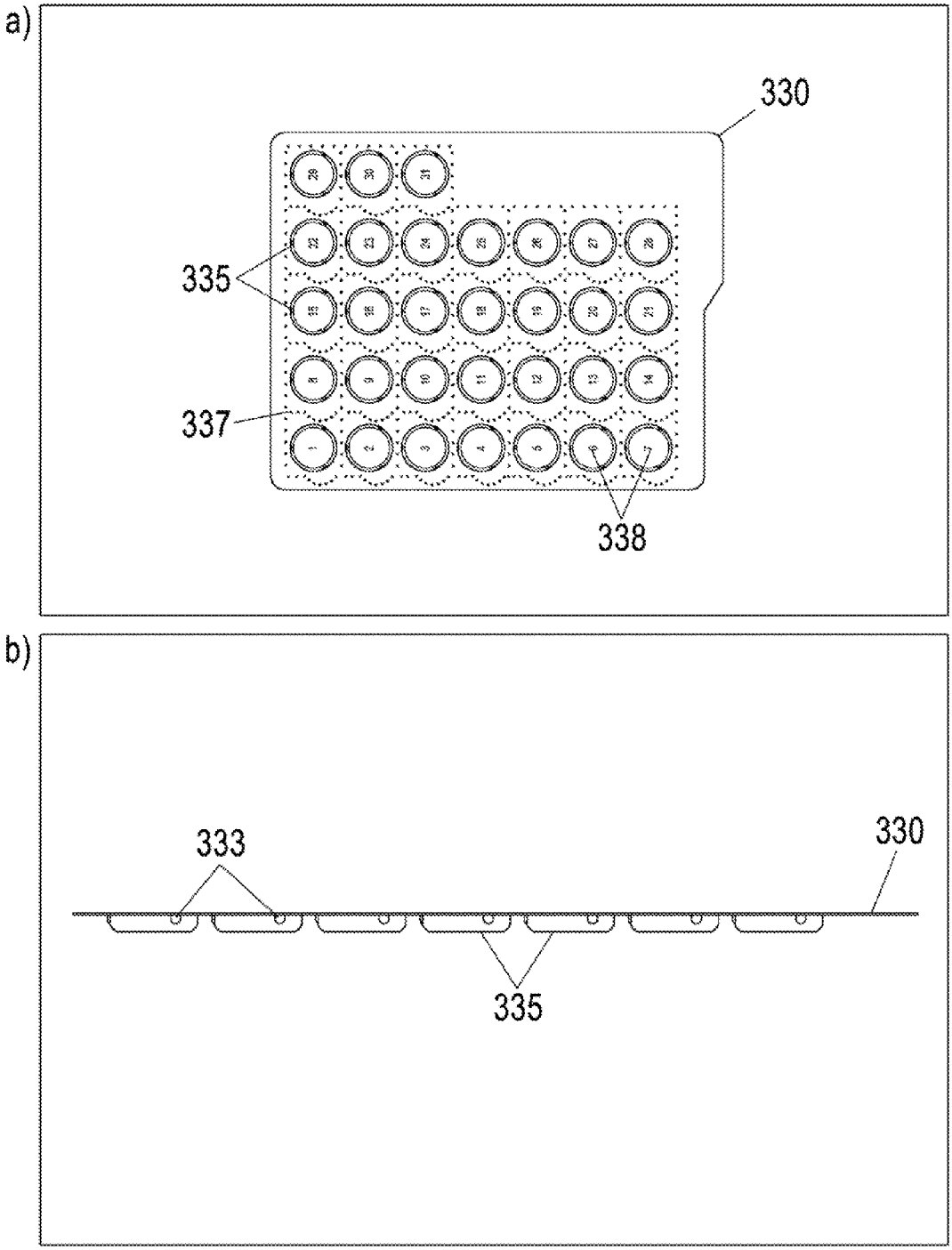
FIG. 3*a-b* illustrates a top view and a side view of the pill lid.

FIG. 2*a* illustrates a top view of the pill tray, including the pill chambers 225 and perforations 227. The pill tray lid has corresponding perforations as shown in FIG. 3. FIG. 2*b* is a side view of the pill tray 220 that shows the profile of the pill chambers (i.e. depth and width). In an exemplary embodiment, the pill chambers are one inch in width and 0.5 inch in depth. The pill chambers each have a protrusion or locking tooth 223 that interlock with a matching locking tooth on the pill tray cover (i.e. locking teeth 333 shown in FIG. 3). The perforations 227 allow the user to separate the pill tray into separate sections as desired.

FIG. 3 illustrates a top view of the pill tray lid 330, including pill chamber lids 335 and perforations 337. The pill chambers include markings 338 that provide for organization of the pill chambers. In the example shown in FIG. 3, the markings 338 are numerals that number the chambers from 1 to 31. FIG. 3*b* is a side view of the pill tray cover 330 that shows the profile of the pill chambers 335 (i.e. width and depth). Also shown are locking teeth 333 that interlock with the corresponding teeth of the pill tray via mechanical friction when the pill tray lid is pressed onto the pill tray.

Figure 4:
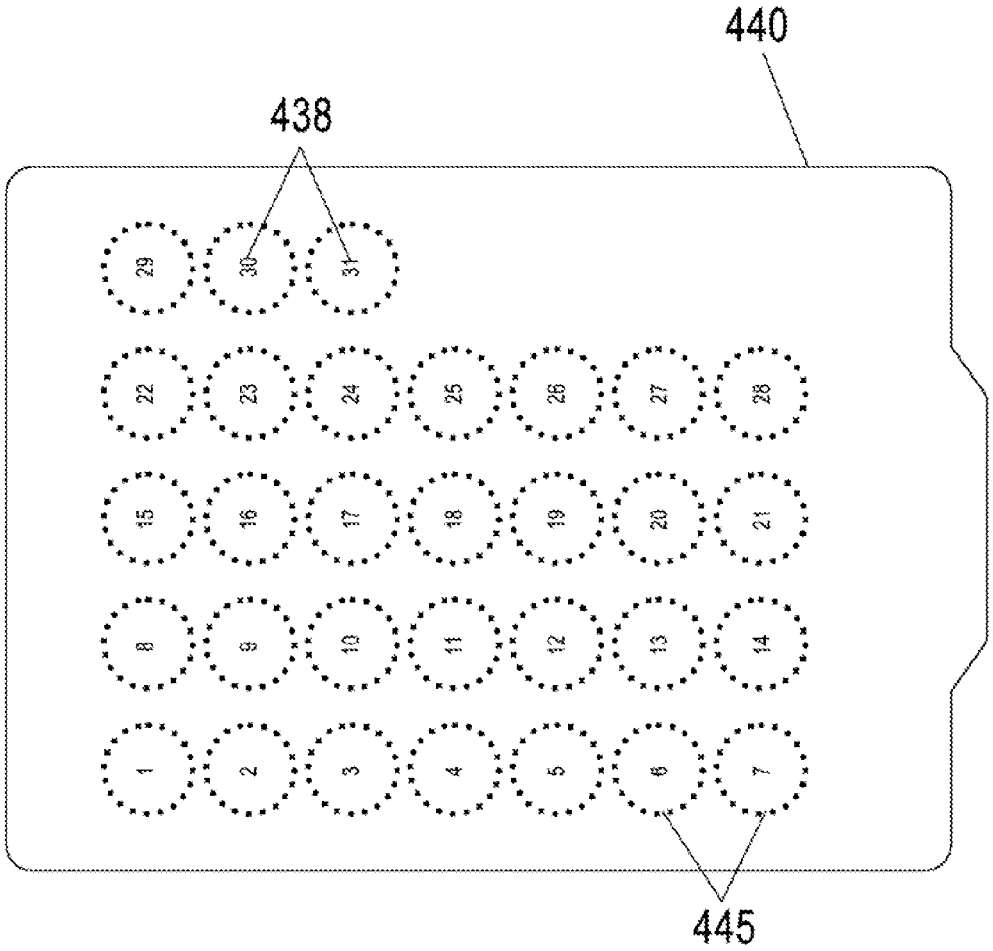
FIG. 4 illustrates a top view of the sliding card.

FIG. 4 illustrates a top view of the sliding card 440. The markings 438 are labels for the pill chambers 445 that allow the user to consume the pill in an organized, accountable manner. The markings 438 also deter unauthorized usage of pills because they can be easily accounted for by the markings. The sliding card 440 slides between the pill tray and the top portion of the clamshell (i.e. above the pill tray and below the clamshell). The user allocates the pills within the pill holes of the clamshell (i.e., holes 115 of FIG. 1) on the surface of the sliding card.

Figure 5:
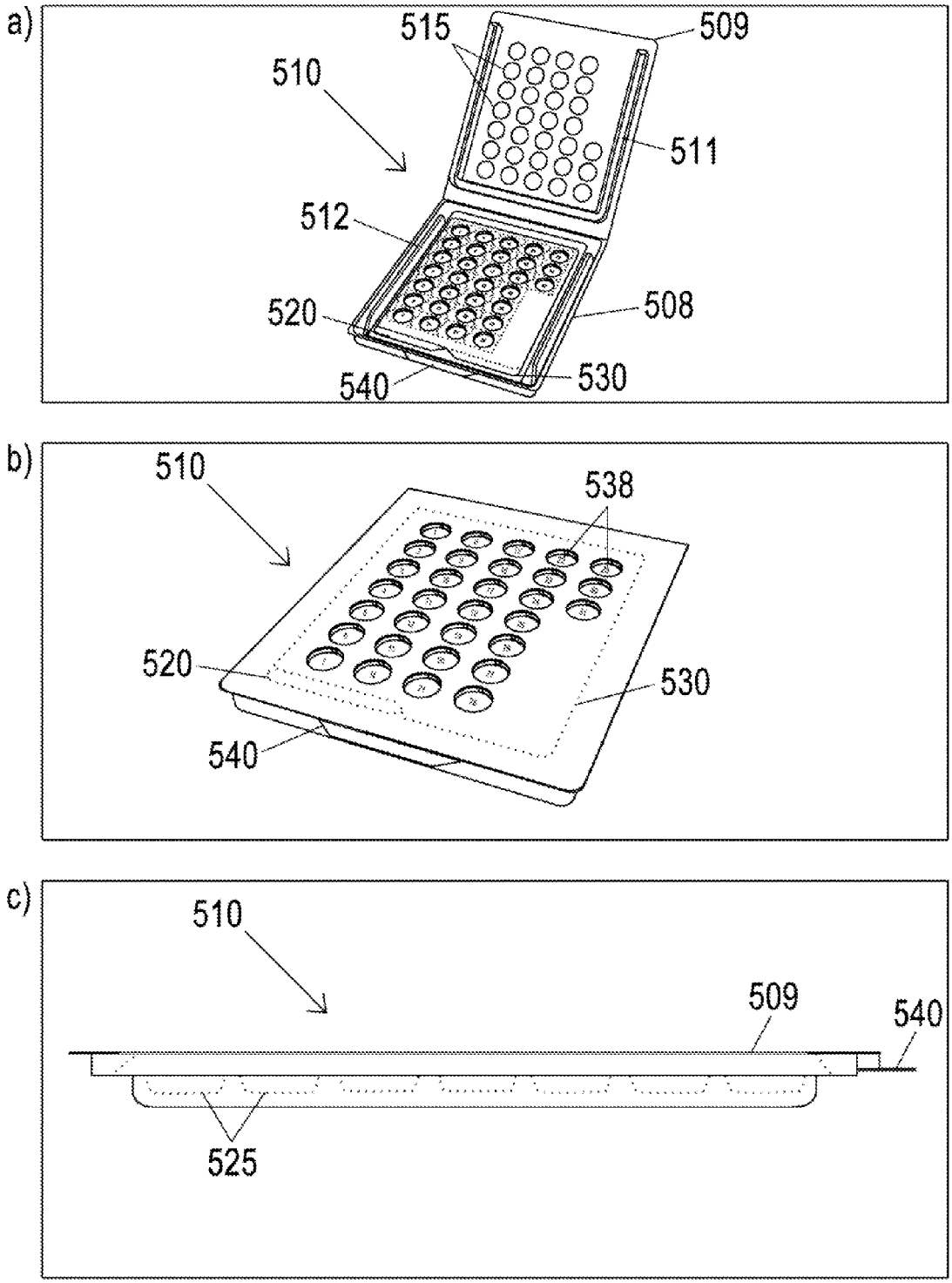
FIG. 5*a-c* illustrates the clamshell container and pill tray assembly.

FIG. 5 illustrates the clamshell container and pill tray assembly. FIG. 5*a* shows the opened clamshell container 510 which houses pill tray 520, tray lid 530, and sliding card 540. FIG. 5*b* shows the closed clamshell 510 and FIG. 5*c* shows a side view of the closed clamshell 510. The dotted lines 520 and 530 outline the pill tray and pill tray lid housed within the clamshell, respectively. Dotted lines 525 show the profile of the pill chambers of the pill tray 520. The claim shell container comprises top portion 509 and bottom portion 508. The top portion 509 includes an array of pill holes 515 which, when the clamshell is closed as shown in FIGS. 5*b* & 5*c*, align with the pill chambers 538 of pill tray 510. As shown in FIG. 5*c*, a portion of the sliding card 540 extends out from the closed clamshell, which allows for the user to pull the sliding card out from the clamshell 510.

Figure 6:
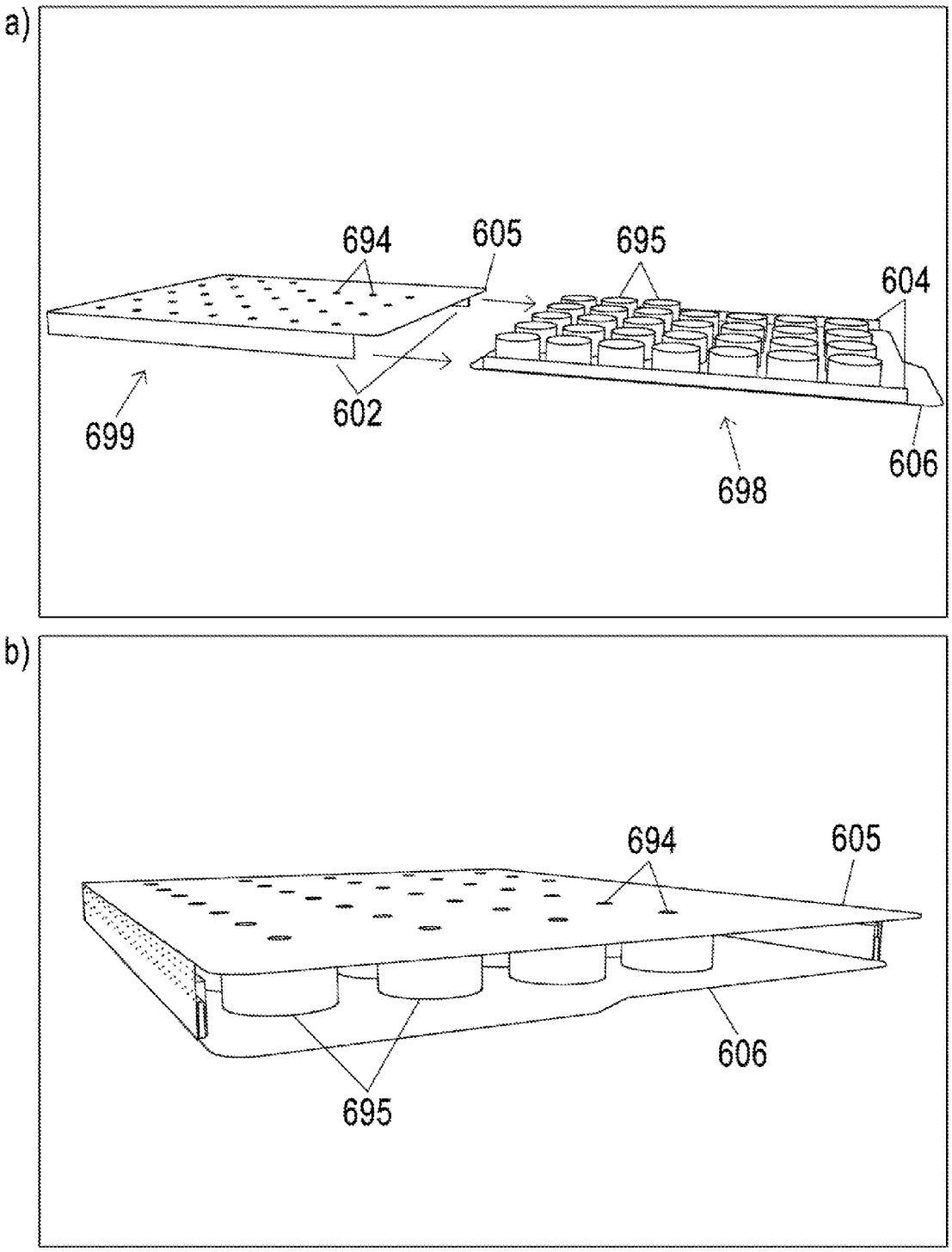
FIG. 6*a-b* illustrates an alternate embodiment of the invention comprising a pill tray and tray lid that slides across the top the pill tray.

FIG. 6 illustrates an alternate embodiment of the invention. Referring to FIG. 6*a*, the device comprises a top portion, pill tray lid 599, and bottom portion, pill tray 698. The bottom portion 698 comprises pill chambers 695. Top portion contains holes 694. The top portion 699 is configured to horizontally slide over bottom portion 698 to cover, or expose, the pill chambers 695 as desired. The pill tray 698 comprises a flat, rectangular base 606 upon which an array of pill chambers 695 is positioned. A pair of upward protrusions 604 perpendicular to the flat base extend along two opposing edges of the flat base of the pill tray 698. The pill tray lid 699 comprises a flat body 605 having an array of holes 694 corresponding to the pill chambers 695, which allow the user to visually inspect the contents of the pill chambers 695 without sliding the tray lid off the pill tray. The pill tray lid 699 has a pair of linear channels 602 that extending along opposing edges of the flat body that are perpendicular to the flat base. The linear channels 602 are configured to receive, and engage with, the protrusions 604 on the pill tray 698 such that the pill tray lid slides over the pill tray to alternatively cover and expose the pill chambers as desired. FIG. 6*b* shows the pill tray in the closed position, with the pill tray lid 699 slid to completely cover the pill tray 698 and its pill chambers 695. In this position the pills in the pill tray 698 are protected from falling out of the pill chambers 695.

Figure 7:
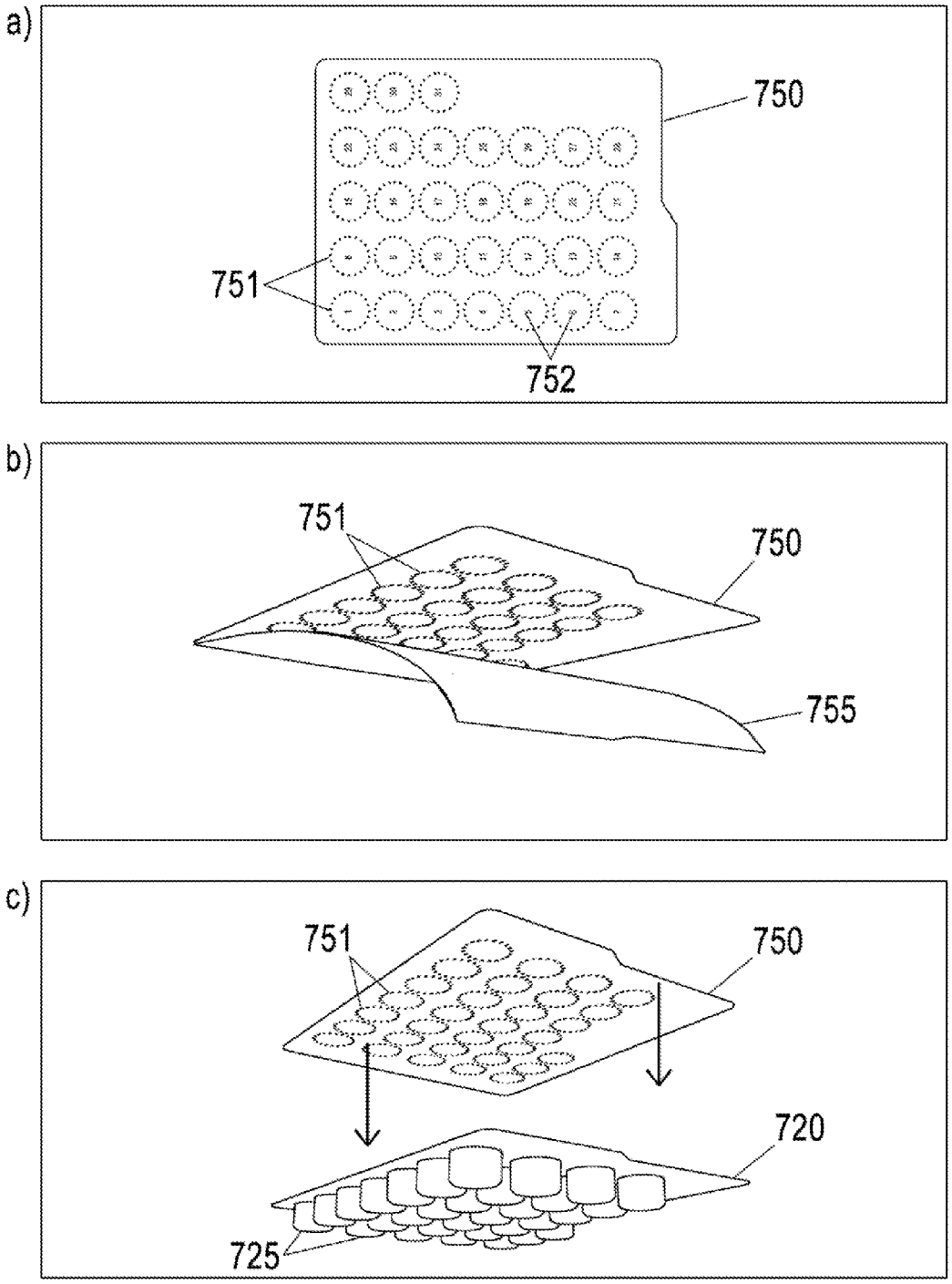
FIG. 7*a-c* illustrates an alternate embodiment of the invention having a user-applied foil seal instead of a removable pill tray lid.
Figure 8:
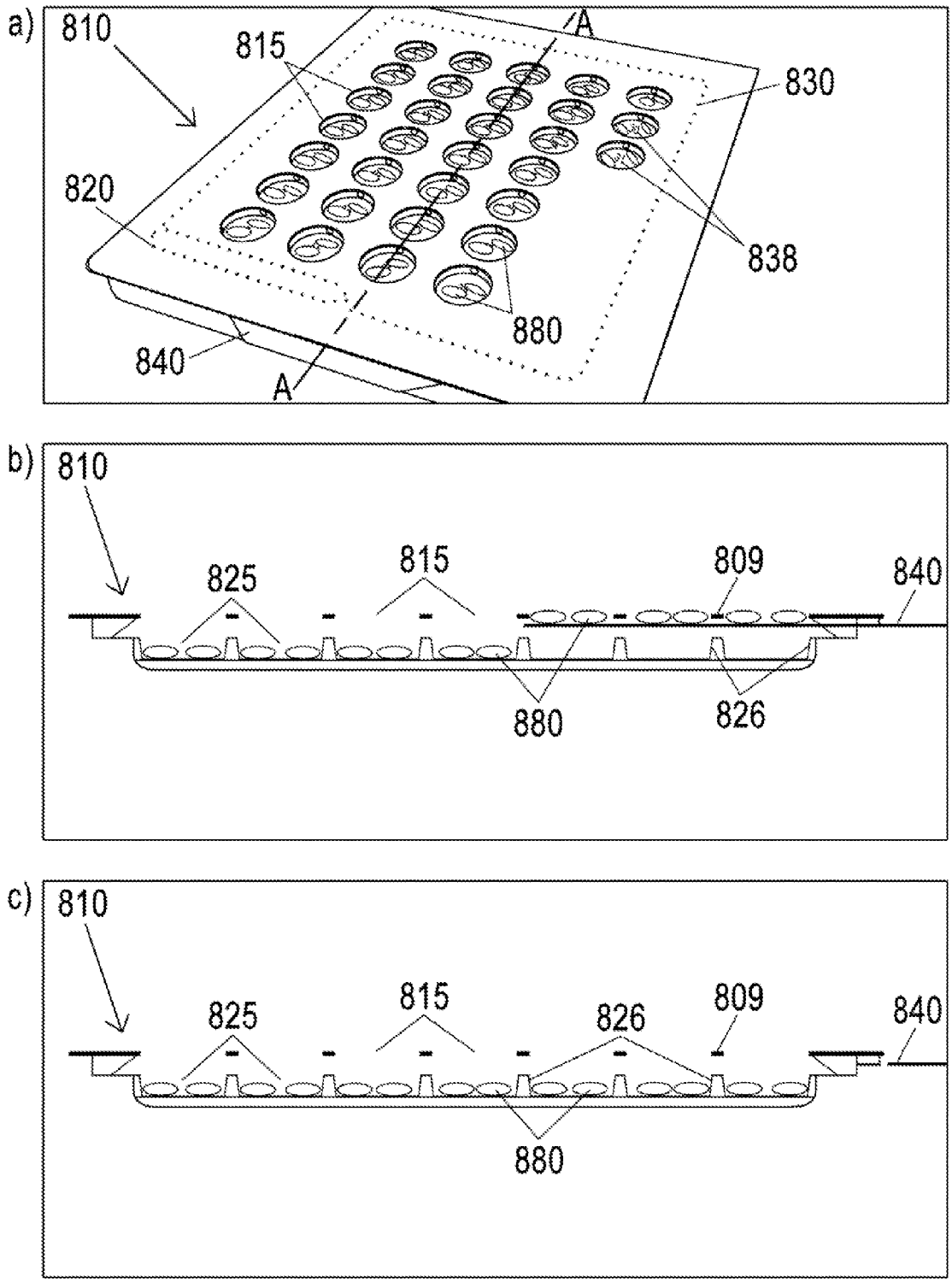
FIG. 8*a-c* illustrates perspective and cross-sectional views of the allocation of pills into the pill chambers of the pill tray in accordance with the present invention.

FIG. 7 illustrates an alternate embodiment of the invention having a pill tray seal (or "foil seal") instead of a removable pill tray lid. FIG. 7*a* shows a top view of the pill tray seal 750, is preferably comprised of a foil sheet (e.g. push-through foil) having an array of markings 751 that correspond to the pill chambers 725 (shown in FIG. 7*c*). However, a suitable paper material could also be employed. The marking 175 are numbered sequentially (i.e. 1 through 31 to correspond to calendar days) but other designations could be used to provide the desired organization. FIG. 7*b* shows the bottom of the pill tray seal 750, which has a paper backing 755 that is peeled off from the pill tray seal 750 to expose an adhesive surface. The areas within the circled portions 751 of the pill tray seal 750 are not coated with adhesive so that the pills do not stick to, or come in contact with, the adhesive. FIG. 7*c* shows the application of the pill tray seal 750 to the top surface of the pill tray 720, which seals the pill chambers 725. The foil seal is applied to the pill tray by the user as shown in FIG. 7 to create an array of encapsulated pill chambers (i.e. encapsulates). The foil seal is printed with markings that indicate, for example, calendar days, numbers, days or times. When the user wants to access the contents of a pill chamber, the user can punch into the foil seal with their finger. In the case of a deformable pill chamber, the user can also push the pills out of the pill chamber and through the seal by pressing the bottom of the pill chamber upwards. As set forth above, the pill tray and pill chambers may be composed of deformable or rigid polymeric material. These markings also correspond to the pill chambers in the pill tray. The foil seal can also include perforations around the perimeter of the pill chambers to allow the foil to be punched out with more ease. This embodiment also allows the user to customize and create their own sealed array of pill chambers. The pill tray and pill tray seal FIG. 8A-C illustrate perspective and cross-sectional views of the allocation of pills into the pill chambers of the pill tray in accordance with the present invention. Referring to FIG. 8*a*, the clamshell pill container 810 houses the pill tray 820 and sliding card 840. The sliding card rests on top of the pill tray 820 and immediately beneath the top portion 809 of the clamshell container 810. Elements 809 represent the cross sections of the top portion of the clamshell, i.e. the material between the pill holes as intersection by line "A" in FIG. 8A. The pill tray rests on the bottom portion of clamshell container 810 as shown in FIGS. 8B-C. The sliding card 840 includes markings that correspond to the pill chambers directly below them. As shown, the user allocates pills 880 into the space formed by the pill holes 815 of top portion 809 and the surface of the sliding card 840, referred to as shallow chambers 838. For example, whatever pills the user wants to place within pill chamber number "15", they will place onto the area marked "15" on the sliding card 840.

FIG. 8B shows a cross-sectional view of the device through the line "A" shown in FIG. 8A wherein the sliding card 840 is pulled partially out of the clamshell container 810. As shown, pill holes 815 are positioned directly above the pill chambers 825 (which are defined by the pill chamber walls 826). Because the pills 880 are supported by the sliding card 840, as the sliding card 840 is pulled out, the pills fall into the pill chambers 825 below. As shown, the pills to the left of the sliding card 840 have fallen into the pills chambers 825, while the other pills remain on the sliding card 840 within the pill holes 815. FIG. 8C shows a cross-sectional view of the device through the line "A" shown in FIG. 8A with the sliding card 840 pulled completely out of the clamshell container 810. Thus, all the pills 880 that were allocated onto the surface of sliding card 840 (within pill holes 815) have fallen into the corresponding pill chambers 825. This process can be repeated by the user to add additional pills to some or all of the pill chambers as desired. This provided an organized and easy way for the user to create an organize pill intake schedule.

If a child or other individual wanted to take a pill from a chamber, they would need to break the foil seal, which would be readily evident, making tampering unlikely. One doing so would seek to minimize detection by taking all the contents of the chamber instead of leaving unwanted pills behind in the pill chambers in order to give the impression that the owner had consumed the contents. However, detection is still evident because the chambers are numerically marked (e.g. sequentially or calendar-based). Thus, detection of tampering is readily evident, which serves as a deterrent. This embodiment allows for user customization wherein the user can create their own array of sealed, pill-containing chambers. Although a foil seal has been described, other suitable materials such as paper could be utilized that allow for a user to conveniently push through the material to access the contents of the pill chamber.

Thus, as set forth above, the present invention provides a simple and effective means for storing, organizing, and dispensing prescription pills. Moreover, the invention provides an effective way for a prescription pill holder to keep track of pills and deter unwanted access. While there have been described herein what are considered to be preferred and exemplary embodiments of the present invention, other modifications of the invention shall be apparent to those skilled in the art from the teachings herein. It is noted that the embodiments disclosed are illustrative rather than limiting in nature and that a wide range of variations, modifications, changes, substitutions are contemplated in the foregoing disclosure and, in some instances, some features of the present invention may be employed without a corresponding use of other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

What is claimed is:

1. A device for storing and organizing pills comprising:

a container having a top portion hingedly connected to a bottom portion, the top portion having an array of pill holes, wherein the top and bottom portions come into contact with each other when the container is in a closed position;

a pill tray containing an array of pill chambers that are accessed from a top surface of the pill tray, wherein the array of pill chambers align with the array of pill holes in the top portion of the container;

a pill tray lid having an array of chamber lids corresponding to the array of pill chambers in the pill try, the pill tray lid configured to reversibly connect with, and cover, the top surface of the pill tray and the pill chambers; and a sliding card configured to slide between the top surface of the pill tray and the top portion of the container, the sliding card having a top surface on which pills are placed;

wherein the container is configured to house the pill tray, pill tray lid, and sliding card.

2. The device of claim 1 wherein the pill tray lid further comprises a protruding notch on an outer surface of each of the chamber lids.

3. The device of claim 1 wherein the pill tray lid include a protruding notch on an outer surface of each of the chamber lids, and each of the pill chambers includes a groove on an outer surface of each pill chamber, the notch and the groove configured to reversibly engage with each other when the pill tray lid is pressed onto the pill tray.

4. The device of claim 1 wherein bottom portion of the container has a pair of opposing linear protrusions that run along opposing edges of the bottom portion, the pill tray configured to rest on the bottom portion of the container within the linear protrusions.

5. The device of claim 1 wherein the sliding card contains markings that correspond to the pill chambers of the pill tray.

6. The device of claim 1 wherein pills are held within a space defined by the pill holes of the top portion of the container and a top surface of the sliding card, the sliding card resting on top of the pill tray such that removal of the sliding card causes the pills to fall into corresponding pill chambers below.

7. The device of claim 1 configured to allocate pills into the pill chambers by the following steps:

receiving pills within a space defined by the pill holes of the top portion of the container and a top surface of the sliding card, the sliding card resting on top of the pill tray and beneath the top portion of the container; and removing of the sliding card from the container to cause the pills to fall into the corresponding pill chambers below.

8. The device of claim 1 wherein the pill chambers are made of a deformable polymeric material.

9. The device of claim 1 wherein the pill chambers are made of a rigid polymeric material.

* * * * *